US009532639B2

(12) United States Patent
Kimble

(10) Patent No.: US 9,532,639 B2
(45) Date of Patent: Jan. 3, 2017

(54) CUSTOMIZABLE CARRIER FOR A PORTABLE ELECTRONIC DEVICE

(76) Inventor: Dena Kimble, Apache Junction, AZ (US)

( * ) Notice: Subject to any disclaimer, the term of this patent is extended or adjusted under 35 U.S.C. 154(b) by 0 days.

(21) Appl. No.: 13/587,448

(22) Filed: Aug. 16, 2012

(65) Prior Publication Data

US 2014/0048574 A1 Feb. 20, 2014

(51) Int. Cl.
*A45F 5/02* (2006.01)
*A45F 5/00* (2006.01)

(52) U.S. Cl.
CPC ..... *A45F 5/00* (2013.01); *A45F 2005/006* (2013.01); *A45F 2200/0516* (2013.01); *A45F 2200/0525* (2013.01)

(58) Field of Classification Search
CPC ..... A45F 5/00; A45F 5/02; A45F 2003/002; A45F 2200/0516; A45F 2200/0525; A45F 2005/006; G06F 2200/1633; G06F 1/1626
USPC ..... 224/257, 610, 578, 930; D3/210
See application file for complete search history.

(56) References Cited

U.S. PATENT DOCUMENTS 5,887,777 A * 3/1999 Myles et al. ..... 224/578
6,220,493 B1 * 4/2001 Iijima et al. ..... 224/578
6,352,186 B1 * 3/2002 Endo ..... 224/254
6,646,864 B2 * 11/2003 Richardson ..... 361/679.3
6,662,986 B2 * 12/2003 Lehtonen ..... 224/675
D533,994 S * 12/2006 Hussaini et al. ..... D3/218
D551,856 S * 10/2007 Ko ..... D3/201
D581,151 S * 11/2008 Aipa ..... D3/201
D675,604 S * 2/2013 Limber ..... D14/250
8,800,762 B2 * 8/2014 Fathollahi ..... H04B 1/3888 206/320
2002/0153400 A1 * 10/2002 Chase et al. ..... 224/610
2005/0127123 A1 * 6/2005 Smithers ..... 224/610
2006/0124676 A1 6/2006 Mastrosimone
2010/0133307 A1 * 6/2010 Martin et al. ..... 224/257
2010/0224519 A1 * 9/2010 Kao ..... 206/320

* cited by examiner

*Primary Examiner* — Corey Skurdal
(74) *Attorney, Agent, or Firm* — Polster, Lieder, Woodruff & Lucchesi, L.C.

(57) ABSTRACT

A customizable carrying case (20) for a portable electronic device has a shell (22) and a strand (36). Shell (22) has a first attachment area (50) and a second attachment area (52) to which a first end (44) and a second end (46) of strand (36) is attached. First end (44) and second end (46) of strand (36) can be detached from first attachment area (50) and a second attachment area (52), permitting a user to interchange more than one strand (36) with shell (22), as a user desires. Static first attachment area (50) and a second attachment area (52) ensures that the portable electronic deviceremains facing a direction that user desires.

7 Claims, 2 Drawing Sheets

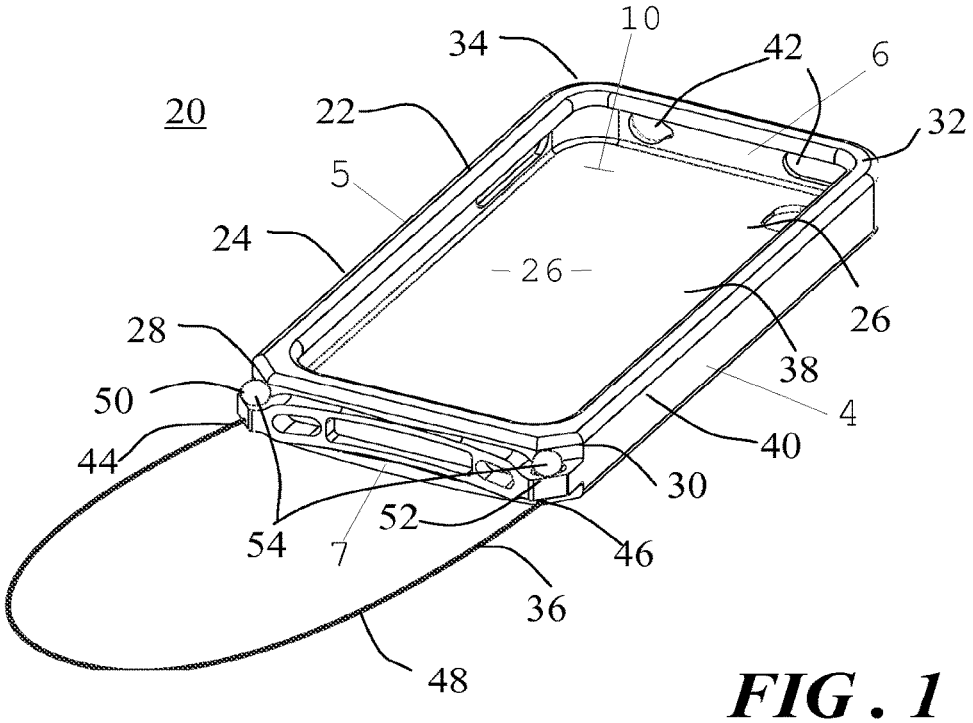
FIG. 1
FIG. 2
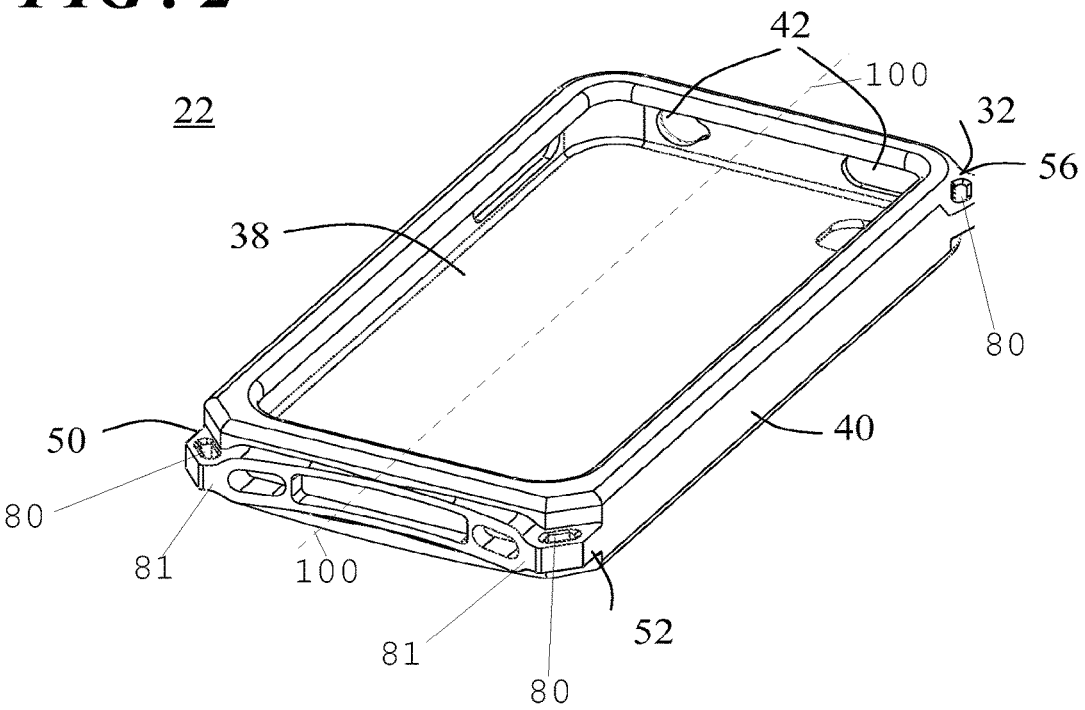

CUSTOMIZABLE CARRIER FOR A PORTABLE ELECTRONIC DEVICE

TECHNICAL FIELD OF THE INVENTION

The present invention relates to the field of portable electronic device access. More specifically, the present invention relates to carrying cases for portable electronic devices.

BACKGROUND OF THE INVENTION

Cases used to protect and carry objects have been in existence for many years. These have been designed to be carried in ways to permit the user to keep their hands free for other tasks. The designs used range from shoulder straps and belts to armbands and the like, each providing the user the ability to efficiently carry their device while still permitting the user to keep their hands free.

Electronic devices are not only becoming more portable, but also much more integrated. Whereas previously an individual may have carried a music player, phone, and other communication device, most people can now be found carrying a single device that incorporates many, if not all, of these functions. With this increased functionality has come a greater dependency upon these devices and the need for immediate access to them.

There are varied methods of carrying these electronic devices, ranging from placing them in a pocket or purse, to various belt clips, and even the option to wear these devices around the neck. While many still place their devices in purses or pockets, or even hold them in their hand, these methods of carrying the devices increase the chances of damage to the face or body or the device. Belt or waist clips provide an ease of access for the user while keeping their hands free, however, there is a greater difficulty in the use of the device, as the devices are tucked away from sight, at the user's waist, inside a pouch or holster.

There are methods of carrying these electronic devices around one's neck, all of which provide a level of use that permits the user to ensure that the devices are readily available, however the lack of customizability of these cases limit the user in the type and form that they can use to carry their electronic device around their neck.

The lack of customizability extends to limiting the methods in which the user may hold or secure the portable electronic device to their person. Where current carrying cases have defined locations at one end of the carrying case, permitting a user to carry a portable electronic device in only one orientation, new portable electronic devices have functionality that permits the user to change views based upon the orientation of the device with respect to the ground. Thus, the user would find it desirable to determine the orientation which is most functional to them, and ensure that they may carry the device in an easily visible location in the said orientation.

BRIEF DESCRIPTION OF THE DRAWINGS

A more complex understanding of the present invention may be derived by referring to the detailed description and claims when considered in connection with the Figures, wherein the like reference numbers refer to similar items throughout the Figures, and:

FIG. 1 shows a perspective view depicting carrying case in accordance with a preferred embodiment of the present invention;

FIG. 2 shows a perspective view showing a variation of the carry case shown in FIG. 1.

DETAILED DESCRIPTION OF THE PREFERRED EMBODIMENTS

Figure 3:
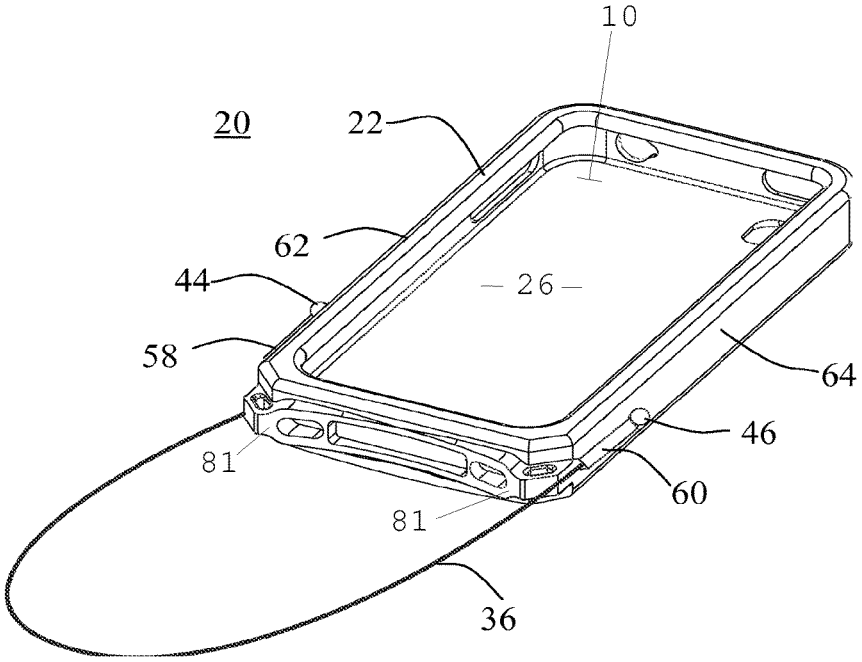
FIG. 3 shows a perspective view depicting carrying case in accordance with an alternative preferred embodiment of the present invention.

FIG. 1 shows a perspective view of a carrying case 20 for a portable electronic device (not shown), which as indicated above may comprise a music player, phone, and other communication device, for example. Carrying case 20 includes a shell 22 having a longitudinal axis 100. Shell 22 includes a first pair of oppositely opposed side walls 4 and 5 and a second pair of oppositely opposed side walls 6 and 7. The side walls all extend upwardly from a back 26. The respective side walls 4, 5, 6, and 7 are joined at their upper ends, referenced to FIG. 1, by a lip or face 24. The components of the shell 22 define an open mouth cavity 10. Shell 22 also has a first corner 28, a second corner 30, a third corner 32, and a fourth corner 34, and a strand 36 associated with it. An inner surface 38 of shell 22 and the cavity 10 is formed and sized to have a contour and size that is substantially similar to the portable electronic device used with the shell 22. An outer silhouette 40 of shell 22 can be any desired shape, including, but not limited to, that of outer surface of the portable electronic device. One skilled in the art will recognize that although FIG. 1 portrays silhouette 40 of shell 22 as a rectangular shape, the silhouette 40 shape is limited only by what the user of carrying case 20 desires. Shell 22 also has several portals 42 to permit the user of carrying case 20 to access various buttons, such as the on/off and volume controls, and for the proper functionality of the portable electronic device.

By hanging carrying case 20 around a user's neck, the user's hands remain free for other uses at all times, even when the user must examine the portable electronic device. Strand 36 has a first end 44, a second end 46, and a length 48. One skilled in the art will recognize that strand 36 can have multiple lengths 48 and be made of varied materials, such as a thread, metal or any other material the user may desire. Furthermore, strand 36 may have different visual and functional patterns, varying from a simple single strand to patterns such as a chain, in which the user may hang other customizing pieces such as charms. Strand 36 is hung around a user's neck such that length 48 of strand 36 is around the user's neck, first end 44 is attached to carrying case 20 at a first attachment area 50, and second end 46 is attached to carrying case 20 at a second attachment area 52. First attachment area 50 is positioned along first corner 28 and second attachment area 52 is positioned along second corner 30 silhouette 40 of shell 22. One skilled in the art will recognize that while first attachment area 50 and second attachment area 52 are shown extending outwardly from the silhouette 40, that first attachment area 50 and second attachment area 52 need not protrude from the silhouette 40. Rather, the attachment areas may extend inwardly from the silhouette 40. One skilled in the art will also recognize that while first attachment area 50 and a second attachment area 52 are shown to be aligned with first corner 28 and second corner 30 of shell 22, first attachment area 50 and second attachment area 52 may be positioned along any of first corner 28, second corner 30, third corner 32 of fourth corner 34. Preferably, the attachment areas 50 and 52, extend outwardly from the side wall 7 and each defines an ear having an opening 80 (FIG. 2) sized to receive a suitable attachment device to the respective attachment areas 50 and 52. As also shown in FIG. 2, the attachment areas 50 and 52 preferably are formed on a side wall arranged to define a top wall and have ribs 81 associated with them such that the ribs 81 are formed above said associated top or side wall, the rib 81 structure extending along the top wall and between the attachment areas 50 and 52.

First end 44 and second end 46 of strand 36 have attachment means 54 permitting a user to attach and remove first end 44 and second end 46 of strand 36 from first attachment area 50 and second attachment area 52 of shell 22. This permits a user to change which strand 36 is used with shell 22, increasing the customizability of carrying case 20. One skilled in the art will recognize that while FIG. 1 shows a method of attachment wherein strand 36 has a ball at each of first end 44 and second end 46 which can be compressed to pass through first attachment area 50 and second attachment area 52 of shell 22 to secure strand 36 to shell 22, any other method of attachment between strand 36 and shell 22 can be used, so long as the user may detach and reattach strand 36 of shell 22.

Length 48 of strand 36 may have variable dimensions. Strand 36 may be adjustable along a length 48 of strand 36 permitting the user to adjust length 48 so that shell 22 hangs at a desired position. Alternatively, length 48 may be fixed for strand 36, and a user may have more than one strand 36 that can be interchanged to achieve desired positioning of shell 22 when carrying case 20 is being used.

FIG. 2 shows a perspective view of an alternate embodiment of shell 22. In this embodiment, the user may determine the orientation in which the user desires the portable electronic device to be hung. In addition to first attachment area 50 and second attachment area 52, shell 22 has a third attachment area 56 designed to permit the user to detach and reattach first end 44 (shown in FIG. 1) and second end 46 (shown in FIG. 1) of strand 36 to second attachment area 52 and third attachment area 56 respectively. Third attachment area 56 is positioned along third corner 32 of shell 22. One skilled in the art will recognize that while third attachment area 56 is shown as extending outwardly from the silhouette 40, the third attachment area 56 need not protrude from silhouette 40. Rather, third attachment area 56 may extend inwardly, if desired. One skilled in the art will also recognize that while third attachment area 56 is shown to be aligned with third corner 32, third attachment area 56 may be aligned with either third corner 32 or fourth corner 34. Also, one skilled in the art will recognize that while only three attachment areas are shown in FIG. 2, carrying case 20 may have attachment areas along first corner 28, second corner 30, third corner 32 and fourth corner 34 simultaneously, permitting the user ability to determine which orientation in which he/she desires the portable device to lay.

FIG. 3 shows a perspective view of an alternate embodiment of shell 22. This embodiment provides alternate attachment areas for strand 36 to be attached to shell 22. Shell 22 has a first side attachment area 58 and a second side attachment area 60 aligned along the opposed side walls 4 and 5 respectively a first side 62 and second side 64 of shell 22. First end 44 and second end 46 of strand 36 are fed through first side attachment area 58 and second side attachment area 60 and are secured such that first end 44 and second end 46 of strand 36 do not become unintentionally disengaged from shell 22. One skilled in the art will recognize that while FIG. 3 shows a method of attachment wherein strand 36 has a ball at each of first end 44 and second end 46 which can be compressed to pass through first side attachment area 58 and second side attachment area 60 of shell 22 to secure strand 36 to shell 22, any other method of attachment between strand 36 and shell 22 can be used, so long as the user may detach and reattach strand 36 to shell 22.

In summary, the present invention teaches customizable carrying case 20 for a portable electronic device. Carrying case 20 has a shell 22 and a strand 36, permitting a user to carry the portable electronic device around the user's neck. Furthermore, carrying case 20 is designed to permit the user to interchange more than one strand 36 that to be used with shell 22, permitting the user a level of customizability.

A first attachment area 50 and a second attachment area 52 permit a user to attach and detach strand 36 from shell 22. Two static attachment areas ensure that carrying case 20 will remain with face 24 of carrying case 20 either towards the user or away from the user, as the user would desire.

By providing the opportunity to permit a user to alter the orientation in which the portable electronic device hangs around the user's neck, an additional method of customizability is provided. The user may determine the most desired orientation and ensure that the portable electronic device remains in that position in a readily visible location.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A carrier for a portable electronic device having a longitudinal axis comprising:

a one piece enclosure for the electronic device, the enclosure including a shell having a predetermined shape, the shell having a continuous back wall, a first pair of spaced oppositely opposed continuous and uninterrupted side walls formed with said back wall and extending outwardly therefrom, a second pair of oppositely opposed continuous and uninterrupted side walls formed with said back wall and extending outwardly therefrom arranged to define a top wall and a bottom wall for said carrier, and a continuous and uninterrupted lip extending about said opposed side walls, said lip being spaced from said back wall to define a closed bottom but open mouth cavity surrounded by said opposed side walls, said cavity generally corresponding to the longitudinal axis of the electronic device permitting insertion of said electronic device within said carrier, the lip adapted for holding said electronic device in place within the carrier;

at least the top wall of said second pair of oppositely opposed side walls having ears formed on opposite corners of said top wall, said ears extending outwardly from the top wall parallel to the longitudinal axis of the carrier for attaching a strand to said carrier; said top wall having a rib structure associated with said ears, said rib structure being integral with but formed above and extending outwardly from said top wall, the rib structure being formed below said ears but extending between said ears along said top wall, the back wall, the oppositely opposed first and second pairs of side walls, the ears, the rib structure and the lip are integrally formed with one another as a single structure defining the closed bottom but open mouth cavity for the enclosure; and a strand attached to said ears.

2. The carrier of claim 1 wherein the back wall has at least one enclosed opening formed in it.

3. The carrier of claim 2 wherein at least two of the respective first and second oppositely opposed side walls have at least one peripherally closed opening formed in it.

4. The carrier of claim 3 wherein the enclosure is a molded part.

5. The carrier of claim 4 wherein the lip completely circumscribes the open mouth cavity.

6. The carrier of claim 5 wherein the strand is removably attached to said ears.

7. The carrier of claim 6 wherein the openings in the carrier permit access to control functions for the electronic device.

* * * * *